US006027056A

United States Patent [19]

Maciejewski et al.

[11] Patent Number: 6,027,056

[45] **Date of Patent: *Feb. 22, 2000**

[54] SLURRYING OIL SAND FOR HYDROTRANSPORT IN A PIPELINE

[75] Inventors: Waldemar Maciejewski, Edmonton; Jim McTurk; Derrick Kershaw, both of Fort McMurray, all of Canada

[73] Assignees: Alberta Energy Ltd.; AEC Oil Sands Limited Partnership; Athabasca Oil Sands Investments, Inc.; Canadian Occidental Petroleum, Ltd.; Canadian Oil Sands Investments, Inc.; Gulf Canada Resources Limited; Imperial Oil Resources, all of Alberta, Canada; Mocal Energy Limited, Tokyo, Japan; Murphy Oil Company, Ltd.; Petro-Canada, Inc., both of Alberta, Canada

[ * ] Notice: This patent is subject to a terminal disclaimer.

[21] Appl. No.: 09/008,810

[22] Filed: Jan. 20, 1998

Related U.S. Application Data

[62] Division of application No. 08/787,096, Jan. 22, 1997, Pat. No. 5,772,127.

[51] Int. Cl.[7] ..... B02C 19/12

[52] U.S. Cl. ..... 241/62; 241/81; 241/101.8

[58] Field of Search ..... 366/136, 137; 208/370, 390, 391; 241/20, 21, 101.8, 80, 97, 24.11, 24.1, 24.15, 29, 23, 81, 62; 209/3, 273, 164

[56] References Cited

U.S. PATENT DOCUMENTS

| | | | |
|---|---|---|---|
| 4,437,982 | 3/1984 | Wasson | 209/273 |
| 4,635,860 | 1/1987 | Kruyer | 241/23 |
| 5,039,227 | 8/1991 | Leung et al. . | |
| 5,264,118 | 11/1993 | Cymerman et al. . | |

*Primary Examiner*—Mark Rosenbaum

*Attorney, Agent, or Firm*—Millen, White, Zelano & Branigan, P.C.

[57] ABSTRACT

A mixer circuit, in the form of a vertically oriented stack of components, functions to slurry oil sand with water in preparation for pumping through a pipeline. The oil sand is initially dropped from the end of a conveyor. It is contacted in mid-air with a stream of water to distribute the water through the oil sand and to wet the latter. The mixture drops into a downwardly slanted trough. The water and oil sand mix as they move turbulently through the open-ended trough. The slurry is deflected as it leaves the trough and is spread in the form of a thin sheet on an apron. It is then fed over screens to reject oversize lumps. The screened slurry drops into a pump box. The rejected lumps are comminuted in an impactor positioned at the end of the screens. The comminuted oil sand is screened to remove remaining oversize lumps and the screened comminuted oil sands are delivered into the pump box. The structure is compact and the oversize reject loss is relatively low.

3 Claims, 1 Drawing Sheet

SLURRYING OIL SAND FOR HYDROTRANSPORT IN A PIPELINE

CROSS REFERENCE TO RELATED APPLICATION

This application is a divisional application of parent application Ser. No. 08/787,096 filed Jan. 22, 1997 now U.S. Pat. No. 5,772,127.

FIELD OF THE INVENTION

This invention relates to a process and mixer circuit for mixing oil sand with water to produce a slurry which can be pumped through a pipeline.

BACKGROUND OF THE INVENTION

The McMurray oil sands of Alberta constitute one of the largest deposits of hydrocarbons in the world.

At the present time, there are two very large scale plants extracting bitumen (a heavy and viscous oil) from these oil sands. Each of these plants incorporates a sequence of mining, bitumen extraction and bitumen upgrading operations.

For many years, the as-mined oil sand was moved by conveyor belt assemblies from the mine site to the extraction plant.

In recent years, slurry pipelines have begun to replace the conveyor belt systems.

In connection therewith, one needs to provide suitable means for slurrying the oil sand with water and entrained air, to produce a slurry that is suitable for pumping down the pipeline.

The mixer circuit so provided is required to cope with very large volumes of throughput—typically 10,000 tons of oil sand per hour. The oil sand is highly erosive, so the mixer circuit should have minimal moving parts and be very durable. In addition, the as-mined oil sand contains a variety of lumps including rocks, clay lumps, and oil sand lumps. The concentration of lumps is greater in winter, when some of the oil sand reports in the form of frozen chunks. Usually the as-mined oil sand will have passed through a double roll crusher prior to slurrying, to reduce lump size below 24 inches. However, the crushed oil sand still contains oversize lumps which are unsuitable for pumping and feeding into the pipeline. Therefore the mixer circuit requires some means for rejecting the oversize lumps (otherwise referred to herein as "oversize").

In U.S. Pat. No. 5,039,227, issued to Leung et al and assigned to the owners of the present application, one mixer circuit for this purpose has been disclosed.

In the Leung et al mixer circuit, an oil sand stream is dropped from the end of a conveyor into a mixer tank. The mixer tank is open-topped, has a cylindrical body and conical bottom and forms a central bottom outlet. A swirling vortex of slurry is maintained in the tank and the incoming oil sand is fed into it. Slurry leaves the tank through the bottom outlet, is screened using vibrating screens to reject oversize, and is temporarily collected in an underlying pump box. Some of the slurry in the pump box is withdrawn and pumped back through a return line to be introduced tangentially into the mixer tank to form the swirling vortex. The balance of slurry in the pump box is withdrawn and pumped into the pipeline.

The Leung et al mixer circuit has been successfully applied on a commercial scale. However, it is characterized by certain shortcomings.

One problem has to do with the fact that a large proportion of the produced slurry has to be pumped back into the mixer tank to maintain the vortex. As a result, the slurry volume that undergoes screening is about twice the volume pumped into the pipeline. This requires provision of a very large screen area. The screens are necessarily located in confined quarters. As a result, one cannot increase the throughput of the circuit because the screens constitute a bottleneck that is not easily resolved.

Another problem lies in the oversize reject rate. At present the screens reject lumps having a diameter greater than 2 inches. About 10% of the oil sand feed is so rejected. These rejects represent a significant oil loss. To reduce this loss, the rejects are conveyed to a second mixer circuit and are re-processed. This is expensive to implement.

From the foregoing, it is apparent that there is a need for a mixer circuit which operates without slurry recycle and which has improved reject rates.

It is the purpose of the present Invention to provide such a mixer circuit.

SUMMARY OF THE INVENTION

In a preferred form of the invention, we have provided a stack of vertically oriented components which convey the oil sand and water downwardly along a generally zig-zag path, comprising:

- A conveyor having a discharge end for delivering a continuous stream of oil sand that falls through air into a trough;
- A pipe for delivering a stream of water which contacts and wets the falling oil sand in mid-air;
- The trough being downwardly slanted, open-topped and positioned in spaced relation below the conveyor discharge end and the water pipe. The trough is operative to receive the mixture of oil sand and water and confine it temporarily to allow the oil sand and water to turbulently mix and form a slurry stream as they flow along its length and discharge from its open lower end;
- An upstanding wall positioned adjacent the trough's lower end and spaced therefrom so that the slurry stream hits it and is deflected, with the result that its direction of flow is changed and further mixing is induced;
- An apron providing a broad surface for receiving the deflected stream, whereby the stream is spread out and thinned to form a slurry sheet adapted to efficiently utilize the screen area;
- A first screen assembly for receiving and screening the slurry sheet to reject oversize and produce a screened slurry stream; and
- A pump box for collecting the screened slurry stream and feeding a pump to deliver the slurry into the pipeline.

This assembly has successfully been tested to demonstrate:

- that a slurry suitable for pipeline conveyance can be formed using only the amount of water required for hydrotransport in the pipeline; and
- that the screen area required for each unit volume of oil sand treated is reduced in comparison to our prior art system.

It has been found that the water needs to contact the curtain of falling oil sand in mid-air. If the water is added at the trough, it has a tendency to channel through the oil sand and mixing is inadequate. The oil sand then does not flow easily along the trough. It has been found that contacting the oil sand in mid-air with water yields good distribution of the water in the oil sand and produces a slurry that flows easily on contacting the trough surface.

In a preferred extension of the invention, the rejected oversize lumps from the first screen assembly are fed directly into an impactor and comminuted. The comminuted product is screened by a second screen assembly to reject any remaining oversize. The comminuted, screened product is then delivered into the same pump box which receives the screened slurry from the first screen assembly.

As a result of combining components in this way, the following improvements have been achieved:

- the vertical stacking of the components yields a structure that is compact relative to the prior assembly amd relies on gravity to mobilize the oil sand and water;
- the need for recycling slurry has been eliminated, with the result that screen loading is decreased; and
- reject rates have been reduced below 3%.

Broadly stated, in one aspect the invention comprises a process for slurrying oil sand, containing oversize lumps, with water to produce a slurry and removing oversize lumps from the slurry to produce slurry suitable for pumping through a pipeline, comprising: dropping the oil sand through air from the discharge end of a conveyor onto a downwardly slanted surface spaced below the conveyor discharge end; contacting the oil sand with a stream of water as the oil sand moves through the air between the conveyor discharge end and the surface, to wet the oil sand; mixing the oil sand and water as they move together along the surface, to form a slurry stream; discharging the slurry stream onto first screen means and screening it to reject oversize lumps; and directing the screened slurry into a pump box prior to pumping it into a pipeline.

Broadly stated, in another aspect the invention comprises an assembly of vertically oriented components for slurrying oil sand, containing oversize lumps, with water to produce a slurry and removing oversize lumps from the slurry to produce slurry suitable for pumping through a pipeline, comprising: conveyor means, having a discharge end, for delivering and dropping a stream of oil sand; a downwardly slanted surface positioned in spaced relation below the conveyor means discharge end, so that the oil sand drops thereon; means for delivering a stream of water so that it contacts and wets the oil sand as it drops between the conveyor means discharge end and the support surface; whereby the oil sand and water may mix as they move along the surface and form a slurry stream; first screen means for screening the slurry stream to reject oversize lumps and produce screened slurry; and pump box means for receiving the screened slurry.

DESCRIPTION OF THE PREFERRED EMBODIMENT

Figure 1:
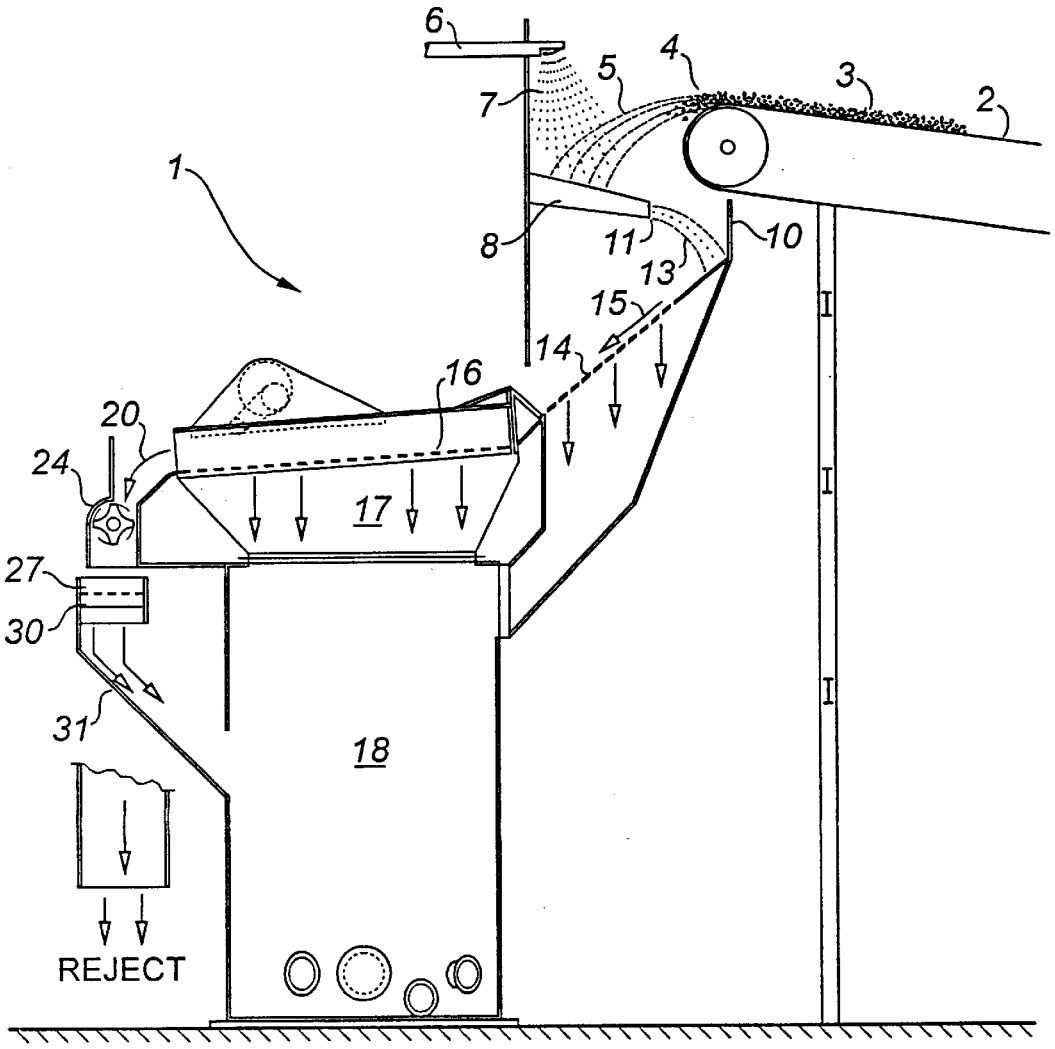
FIG. 1 is a schematic side view showing the preferred embodiment of the invention.

As-mined oil sand to be pipelined is first crushed before conveying it to a mixer circuit 1. This is commonly done by passing it through a set of double rolls, producing 24 inch product. This pre-treatment (which forms no part of the invention) is done to break down the very large contained lumps.

The crushed oil sand contains lumps of varying size and composition.

The mixer circuit 1 comprises a series of downwardly arranged components.

The uppermost component is a conveyor 2 for continuously delivering a stream of crushed oil sand 3. The oil sand cascades or falls from the discharge end 4 of the conveyor 2—it drops downwardly through an air space 5.

A horizontal pipe 6 is positioned opposite to the conveyor discharge end 4. The pipe discharges a stream 7 of water into the falling oil sand in mid-air at a sufficient rate so that the water/oil sand ratio is equivalent to that of the pipeline slurry. Typically this ratio is about 1:3 by weight. The stream 7 contacts the downwardly descending oil sand is distributed through it and wets it.

The oil sand and water drop into a downwardly slanted, open-topped, open-ended trough 8. The trough is formed of plate steel.

As the oil sand and water move through the trough, they mix turbulently and form a slurry.

A solid, vertical wall 10 formed of steel is positioned adjacent the lower end 11 of the trough 8. The wall 10 is spaced from the trough's lower end 11 and extends across the trajectory path of the slurry stream 13 discharging from the trough.

A downwardly slanted apron 14 extends downwardly from the wall 10 in a direction opposite to that of the trough 8.

The slurry stream 13 hits the wall 10, is deflected and changes its direction of movement, being discharged onto an apron 14 having solid and then apertured portions. In the course of these movements, further turbulent mixing of the oil sand and water occurs. On reaching the apron, the slurry spreads out laterally and is thinned, to form a slurry sheet 15. Some slurry drops through the apertures into the pump box 18.

The slurry sheet 15 flows from the apron 14 onto a contiguous first vibrating screen 16. It is sized to retain +4 inch material.

The slurry 17 passing through the screen drops into a pump box 18. Here the slurry is collected and temporarily retained before being pumped from an outlet into a pipeline (not shown).

The oversize lumps 20 retained by the vibrating screen 16 are delivered into an impactor 24. The lumps 20 are largely oil sand in composition and many disintegrate when impacted by the rotating arms of the impactor, producing comminuted product 27. This product discharges from the outlet of the impactor onto a second vibrating screen 30. The screened comminuted product is discharged through hopper 31 into pump box 18. The oversize lumps retained by the screen 30 are discarded.

The embodiments of the invention in which an exclusive property or privilege is claimed are defined as follows:

1. An assembly of vertically oriented components for slurrying oil sand, containing oversize lumps, with water to produce a slurry and removing oversize lumps from the slurry to produce slurry suitable for pumping through a pipeline, comprising:

- conveyor means, having a discharge end, for delivering and dropping a stream of oil sand;
- a downwardly slanted surface positioned in spaced relation below the conveyor means discharge end, so that the oil sand drops thereon;
- means for delivering a stream of water so that it contacts and wets the oil sand as it drops between the conveyor means discharge end and the support surface;
- whereby the oil sand and water may mix as they move along the surface and form a slurry stream;

first screen means for screening the slurry stream to reject oversize lumps and produce screened slurry; and pump box means for receiving the screened slurry.

2. The assembly as set forth in claim 1 comprising:

means for comminuting the rejected oversize lumps as they leave the first screen means to produce comminuted product; and means for transferring the comminuted product into the pump box means.

3. The assembly as set forth in claim 2 comprising:

second screen means for screening the comminuted product to reject residual oversize lumps before the comminuted product is transferred into the pump box means.

* * * * *